US010667582B2

(12) United States Patent
Hestvik et al.

(10) Patent No.: US 10,667,582 B2
(45) Date of Patent: Jun. 2, 2020

(54) DUTY BELT CORE

(71) Applicant: GENTO AS, Sörumsand (NO)

(72) Inventors: Erik Hestvik, Sörumsand (NO); André Sandvik, Sörumsand (NO)

(73) Assignee: GENTO AS, Sörumsand (NO)

( * ) Notice: Subject to any disclaimer, the term of this patent is extended or adjusted under 35 U.S.C. 154(b) by 0 days.

(21) Appl. No.: 16/080,183

(22) PCT Filed: Feb. 28, 2017

(86) PCT No.: PCT/NO2017/050054
§ 371 (c)(1),
(2) Date: Aug. 27, 2018

(87) PCT Pub. No.: WO2017/150984
PCT Pub. Date: Sep. 8, 2017

(65) Prior Publication Data

US 2019/0053581 A1 Feb. 21, 2019

(30) Foreign Application Priority Data

Feb. 29, 2016 (NO) ..... 20160334

(51) Int. Cl.

| | |
|---|---|
| ***A44B 11/00*** | (2006.01) |
| ***A41F 9/00*** | (2006.01) |
| ***A41F 1/00*** | (2006.01) |
| ***A41F 9/02*** | (2006.01) |
| ***A44B 11/12*** | (2006.01) |
| *A44B 11/26* | (2006.01) |

(52) U.S. Cl.
CPC ..... *A44B 11/006* (2013.01); *A41F 1/008* (2013.01); *A41F 9/002* (2013.01); *A41F 9/025* (2013.01); *A44B 11/12* (2013.01); *A44B 11/266* (2013.01)

(58) Field of Classification Search
CPC ..... A44B 11/006; A44B 11/06; A44B 11/12; A44B 11/125; A41F 9/002; A41F 9/025; A41F 1/008
USPC ..... 2/338, 310, 311, 336
See application file for complete search history.

(56) References Cited

U.S. PATENT DOCUMENTS 5,572,747 A * 11/1996 Cheng ..... A44B 11/12 2/312
5,579,563 A * 12/1996 Sim ..... A41F 9/002 24/170
5,588,186 A * 12/1996 Ko ..... A44B 11/14 24/170
5,749,127 A 5/1998 Hsieh
5,970,585 A 10/1999 Scholey
(Continued)

OTHER PUBLICATIONS

International Search Report and Written Opinion dated May 5, 2017 (PCT/NO2017/050054).

*Primary Examiner* — Gloria M Hale
(74) *Attorney, Agent, or Firm* — Alix, Yale & Ristas, LLP

(57) ABSTRACT

Duty belt core constituting a rigid backbone of a duty belt, comprising a left hand side piece firmly attached to a left hand half of a front belt buckle, a right hand side piece firmly attached to the right hand half of the front belt buckle. Each of the left hand and right hand side pieces is connected to a common back piece via side-symmetrical length adjustment patterns and safety stops preventing accidental disengagement of the side pieces from the common back piece. A belt buckle provided with extensions, as well as use hereof is also disclosed.

20 Claims, 9 Drawing Sheets

(56) References Cited

U.S. PATENT DOCUMENTS

| | | | | |
|---|---|---|---|---|
| 6,193,122 | B1 | 2/2001 | Buckley | |
| 7,032,415 | B2 * | 4/2006 | Young | A41F 1/008 70/18 |
| 8,056,192 | B1 * | 11/2011 | Posner | F16L 33/035 24/16 PB |
| 9,149,090 | B1 * | 10/2015 | Taylor | A41F 9/02 |
| 9,277,776 | B2 * | 3/2016 | Laatz | A44B 11/125 |
| 9,351,526 | B1 * | 5/2016 | Taylor | A44B 11/12 |
| 9,615,631 | B2 * | 4/2017 | Laatz | A41F 9/025 |
| 10,130,131 | B2 * | 11/2018 | Ryou | A41F 1/008 |
| 10,219,585 | B2 * | 3/2019 | Taylor | A44B 11/2526 |
| 10,238,183 | B1 * | 3/2019 | Taylor | A44B 11/12 |
| 2008/0210729 | A1 | 9/2008 | Pittman et al. | |
| 2012/0036618 | A1 * | 2/2012 | Rowland | A41F 9/025 2/311 |
| 2013/0167288 | A1 * | 7/2013 | Rowland | A41F 9/002 2/338 |
| 2016/0227859 | A1 | 8/2016 | Burri | |
| 2017/0020234 | A1 * | 1/2017 | Taylor | A44B 11/2526 |
| 2019/0261745 | A1 * | 8/2019 | Taylor | A44B 11/005 |
| 2019/0281930 | A1 * | 9/2019 | Taylor | A44B 11/125 |

* cited by examiner

DUTY BELT CORE

BACKGROUND

The disclosure concerns a rigid duty belt core.

Duty belts are commonly used by police officers on duty and watchmen in security firms, military personnel, etc. as a means for holding different tools need for protection, for inspection, for conducting arrest of criminals and the like. Such tools may comprise e.g. hand guns, batons, hand cuffs, flashlights, and such tools as a whole impose a significant weight to the belt. It is therefore necessary that duty belts are really strong and sturdy in order to fulfil their intended function, still allowing as much comfort as possible for the user who may need to carry the belt and its additional weight for several hours at the time. Belts with similar functionality may also be used by craftsmen and construction workers who need to carry heavy loads over shorter distances and who may use the belt to relieve their arms for the heaviest weights, instead placing the load on the hips by use of such a belt and associated brackets or hooks.

It is also a challenge that, when using the duty belt, the circumstances may rapidly change. For instance, there may be situations in which the user must run, and the belt should in such situations be really firmly attached to the body in order not to bounce around too much, while in other situations, the user may have to sit down, e.g. in a car or for producing reports on incidents recently happened, and in such situations a really tight fit of the belt would be uncomfortable and may even stop blood from reaching all parts of the body, making limbs going numb. There is also a need for length adjustment of the belt in relation to varying temperatures and the like, e.g. the need for an extra thick jacket or the like. Therefore, even though a "standard" length of the belt may be found for a particular user, there will still be a number of situations where length adjustments are required, and sometimes within a second or two.

For adaption of length, such duty belts are typically provided with length adjustments functions in front, close to the belt buckle. While most of the duty belt is typically made of, or has core made of, a strong and sturdy synthetic material, like casted or extruded polyethylene, the part allowing length adjustment is typically made in a far more flexible material, typical a woven fabric. Thus, the part of the belt allowing length adjustment as mentioned, also introduces an undesired weak point in the belt, a point which allows the belt to bounce more during severe movement.

Another disadvantage of length adjustment of the duty belt in front is that the tools attached to the belt may be slightly displaced on the body of the user when the belt is tightened or slackened.

A disadvantage of a duty belt which is difficult or time consuming to adjust, it that the user will tend to wear the belt over time at a tightening level too hard to be comfortable, which may cause reduced blood circulation and a strain on nerve paths that over time may cause health problems.

U.S. Pat. No. 5,572,747 describes a belt and buckle assembly in which a clamping plate which is turned about a transverse pivot pin at one end of the buckle has two perpendicular teeth and is supported on a torsional spring. The belt has two longitudinal rows of sloping teeth and a plurality of longitudinal rows of spaces alternatively disposed at the back side of the belt near its tail. The teeth of the clamping plate allow the sloping teeth of the belt to pass forward and stop them from backward movement. The belt is released from the buckle if the clamping plate is moved downward to compress the torsional spring and to shift the teeth into the longitudinal rows of spaces.

U.S. Pat. No. 5,749,127 concerns a fastening belt for a dive knife including a belt and a belt buckle comprising a male and a female member separately connected to respective ends of the belt. Ratchet-type length adjustment is provided to one of the belt buckle members in interaction between the buckle and teeth provided at the front side of a belt end.

There is thus a need for a belt which does not exhibit any weak points in relation to length adjustment, which is really strong and rigid and which still allows quick and easy length adjustment according to the user's needs. The more rigid the belt, the less tightening is required to maintain the desired properties.

SUMMARY

The disclosed embodiments provide a duty belt or a core for a duty belt fulfilling the varying needs for the typical user, i.e. providing rigid and sturdy attachment of tools, holding the tools in a fixed position on the user's body independent of any length regulation of the belt, while also allowing quick and safe length regulation.

Also provided is a duty belt core allowing the user the benefits in the perspective of HES (Health, Environment and Safety).

The disclosed embodiments ensure that the function of slackening the belt (extending its length) cannot accidentally lead to a full disengagement between the parts thereof, resulting in the user losing the belt.

By "duty belt core" is understood the functional part of the duty belt, i.e. the part providing the required functions for connection, extension, contraction, rigidity, sufficient strength to hold tools etc., while a complete duty belt also typically comprises a soft lining or cushion facing the user, making the duty belt more comfortable to wear.

By "side-symmetrical length adjustment arrangement" is understood an arrangement allowing equal extension and contraction (slackening and tightening) of both side pieces of the duty belt core.

It is preferred that the side symmetrical length adjustment arrangement is a ratchet type length adjustment arrangement By "ratchet type length adjustment arrangement" as used herein is understood a connection where the belt can be tightened by simply pushing the elements thereof further into one another while slackening the belt on the other hand requires the release of an engage-release mechanism as described below. By pushing inwards, a peg of the engage-release member slides past any desired number of protrusions in the pattern of repetitive protrusions and recesses in question.

According to other embodiments, operation of (at least one of) the engage-release members are required for tightening the duty belt core as well as for slackening it.

When commenting on properties of "the belt" in this disclosure, unless the contrary is specifically stated, it is understood that such reference is valid for the duty belt core according to the disclosure as such, as well as for any combination of the duty belt core with any suitable lining, cushioning, and padding.

In the detailed description below, all exemplification is given in relation to a ratchet type length adjustment arrangement. It should be pointed out that all functionality is the same also with other embodiments except the one mentioned, namely that even tightening needs manual operation of the engage-release member for the embodiments lacking the ratchet type length adjustment.

BRIEF DESCRIPTION OF THE DRAWINGS

Below the disclosed duty belt core is described in further detail in relation to some non-limiting exemplifying embodiments with reference to the accompanying drawings, where.

DETAILED DESCRIPTION

In the discussions that follow, from time to time we refer to "left hand side piece" and "right hand side piece" while other times simply "the side pieces" when referring to both of them in common. It should be understood that at a general level there is no functional difference between the two and in most embodiments they will appear as mirror images of one another.

Figure 1:
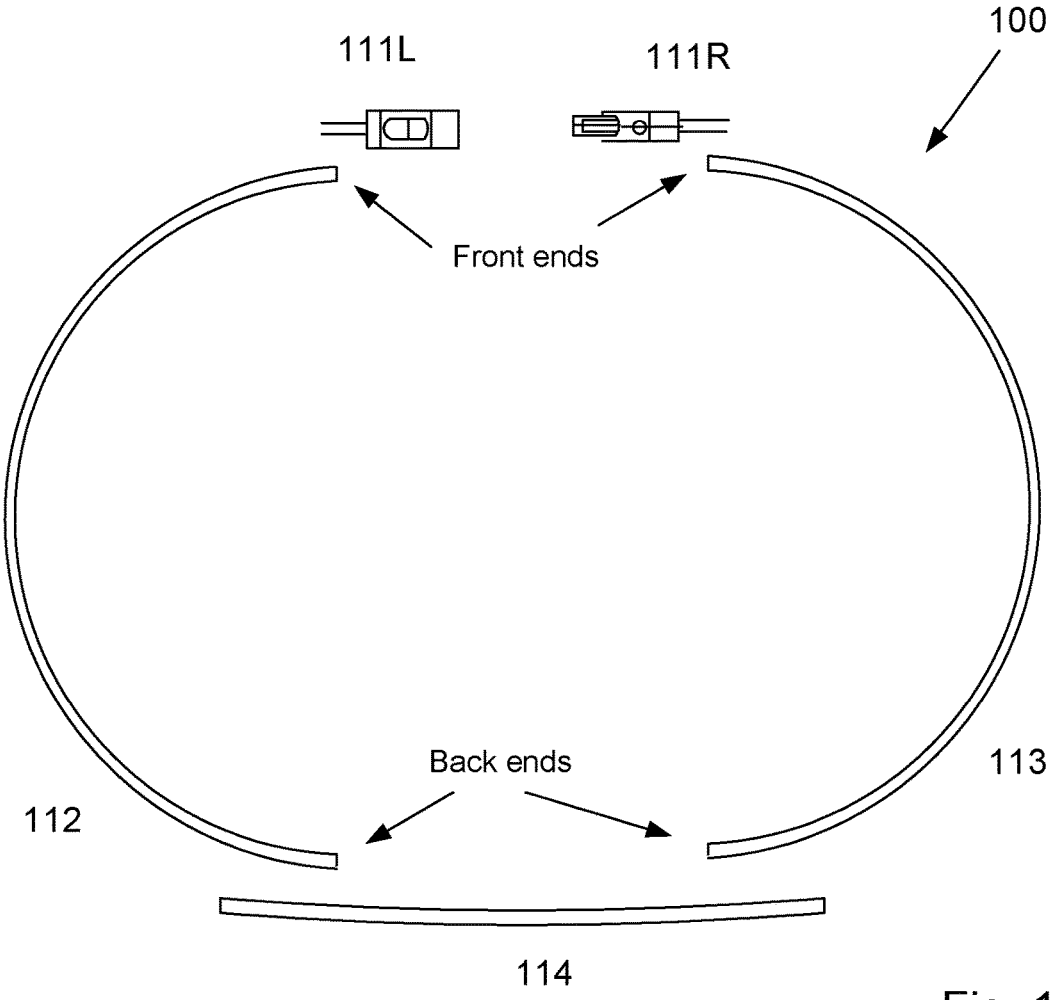
FIG. 1 illustrates the main parts of the duty belt core.

FIG. 1 shows the general parts of the duty belt core 100 according to the disclosure, namely a belt buckle 111, comprised by a left hand side half 111L and a right hand side half 111R to be connected in a per se known manner; further comprising a left hand piece 112, a front end of which to be firmly and preferably rigidly attached to the left hand side half 111L of the belt buckle and a right hand piece 113, a front end of which is to be firmly and preferably rigidly attached to the right hand side half 111R of the belt buckle. The back ends of the left hand piece 112 and the right hand piece 113 of the belt buckle are to be attached to a particular back piece 114 in a manner to be further described below.

It should be noted that while the left hand piece of the duty belt core is generally referenced to by numeral x12, such as 112, 212, etc. Similarly the right hand piece may be referenced to as 113, 213 etc., while the back piece is referenced as 114, 214, etc.

Figure 2A:
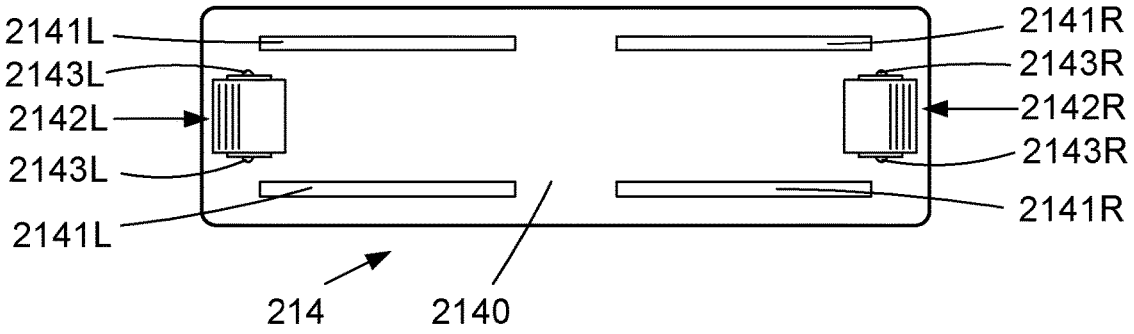
FIGS. 2A-2F illustrate in a first embodiment the attachment between different parts of the duty belt core of the disclosure.

FIG. 2A shows schematically a top view of a first embodiment of the back piece (or common back piece) 214, the right hand side and the left hand side of which being mirror symmetrical. To the left are shown two longitudinal, through slots 2141L and to the right two longitudinal through slots 2141. To the left is shown a pivotal ratchet engage-release member 2142L hinged about a vertical axis and to the right a similar ratchet release member 2142R is shown, also pivotally hinged about a vertical axis. The axis holding the left hand member 2141L is supported by a bracket 2143L having an ear at both sides of the member, said bracket being firmly attached to the main body 2140 of the back piece 214 at an angle perpendicular to the main body 2140. Similarly, the axis holding the right hand member is supported by a bracket 2143R extending perpendicularly from and firmly attached to the main body 2140 of the back piece.

The ratchet engage-release members are each provided with a peg (illustrated in FIG. 4B) arranged to engage with each one of two ratchet type engraved patterns to be described below, until the members are released from said patterns. This means that the ratchet engage-release members have the function of engaging a ratchet type engraved pattern when not actively released by the user, so that the ratchet mechanism is active, i.e. allows movement in a tightening direction but prevents movement in a slackening direction. To hold a engage-release member in engagement with a ratchet type engraved pattern as described when not actively released, it are typically biased by means of a mechanical spring acting between the bracket and the engage-release member.

Figure 2B:
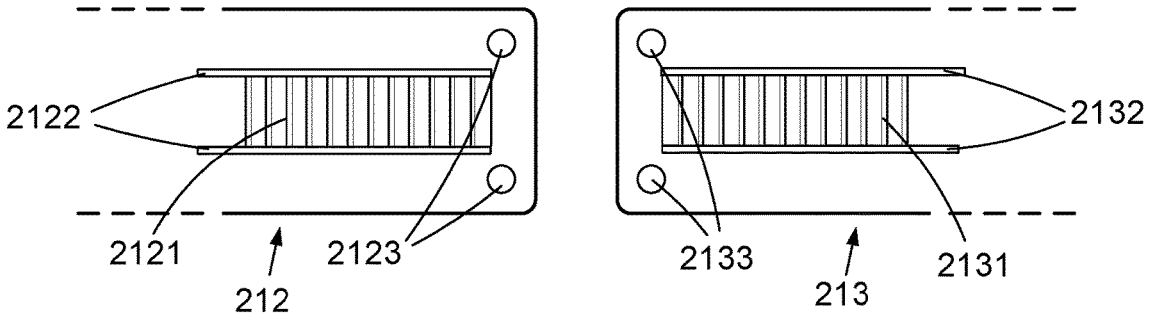

FIG. 2B shows schematically a top view of the back ends of a first embodiment of the left hand piece 212 and the right hand piece 213 respectively of the disclosed duty belt core. The back ends of belt core pieces 212 and 213 as shown are adapted to be fitted to the back piece of FIG. 2A in a manner providing the benefits of the disclosed embodiments. Again the piece to the right appears as a mirror image of the piece to the left. A ratchet type pattern 2121 is engraved in the back end of left hand piece 212 of the duty belt core, the length of which generally corresponding to the length of the slots 2141L of FIG. 2A and dimensioned to allow a convenient length adjustment of the duty belt core, taken into account that similar contribution to the total adjustment is provided at the back end of the right hand piece 213 of the duty belt core. Thus, a ratchet type pattern 2131 is engraved in the back end of left hand piece 213 of the duty belt core, the length of which generally corresponding to the length of the slots 2141 of FIG. 2A At both sides of the ratchet type engraving 2121, through slots 2122 extend in parallel to the slots 2141L, spaced apart similarly to the width of the bracket 2143L. Correspondingly, at both sides of the ratchet type engraving 2131, two parallel slots 2132 extend, parallel to the slots 2141R spaced apart similarly to the width of the bracket 2143R.

Two holes 2123 are shown near the back end of left hand piece 212, adapted to be aligned with the slots 2141L on assembly of the duty belt core. Similarly, tow holes 2133 are shown near the back end of right hand piece 213, adapted to be aligned with the slots 21441R on assembly of the duty belt core.

Figure 2C:
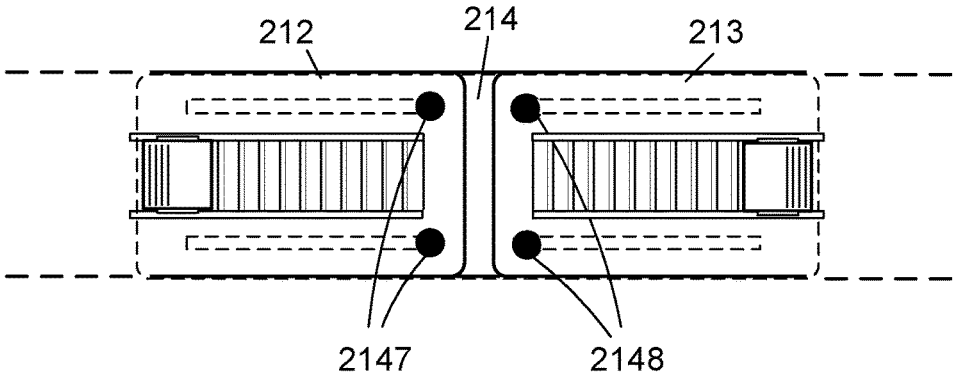

FIG. 2C shows the back piece 214 after assembly to the back ends 212 and 213 respectively. For assembling the parts, the ratchet engage-release members 2142L and 2142R are detached from their respective brackets, the back end of the left hand piece is placed on top of the back piece in an alignment in which the ears of the bracket 2143L extend through the slots 2122, whereafter the ratchet engage-release member 2142L is reattached to the bracket 2143L. After or before the reattachment of ratchet engage-release member 2142L, screws 2147, rivets or the like is inserted through the holes 2123 and the slots 2141L in a manner loose enough to allow sliding displacement of the back piece 214 in relation to the left hand piece 212. So-called Chicago screws may be used in order not to overtighten. Similarly, the back end of the right hand piece 213 is placed on top of the back piece 214 in an alignment in which the ears of the bracket 2142R extend through the slots 2132, whereafter the ratchet engage-release member 2142R is reattached to the bracket 2143R. After or before the reattachment of ratchet engage-release member 2142R, screws 2148, rivets or the like is inserted through the holes 2133 and the slots 2141R in a manner loose enough to allow sliding displacement of the back piece 214 in relation to the right hand piece 213.

Typically, now the duty belt core is provided with some type of lining or cushioning to make the inside thereof softer and more comfortable for the user. This may be done in any convenient and per se known manner and not described in any detail here.

The duty belt core according to the embodiment described above is now ready for use. It is completely rigid the full circle around the user's waist, including the part allowing length adjustment. The available amount of adjustment is determined by the length of the slots 2141L, 2141R and the engravings 2121, 2131 respectively. For a thin user, excessive length of the side pieces 212, 213 may be cut off in front before attaching the side pieces to the belt buckle half in question. In order not to affect the symmetry of the belt core, identical lengths should in case be cut off each side piece.

When in use, the back piece is close to the user's back while the back ends of the side pieces 212, 213 overlaps the back piece (more or less) at the external side of the back piece, see from the user's body. This embodiment ensures that the ratchet engage-release members are found at exactly the same spot on the user's body independent of the tightening and slackening of the belt, the back piece always being positioned centred at the user's back.

Figure 2D:
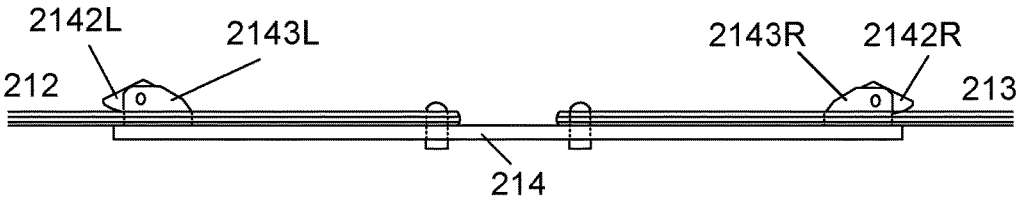

FIG. 2D shows a side view of the assembly of back piece 214, the left hand piece 212 (a small part thereof) and the right hand piece 213 (a small part thereof).

Figure 2E:
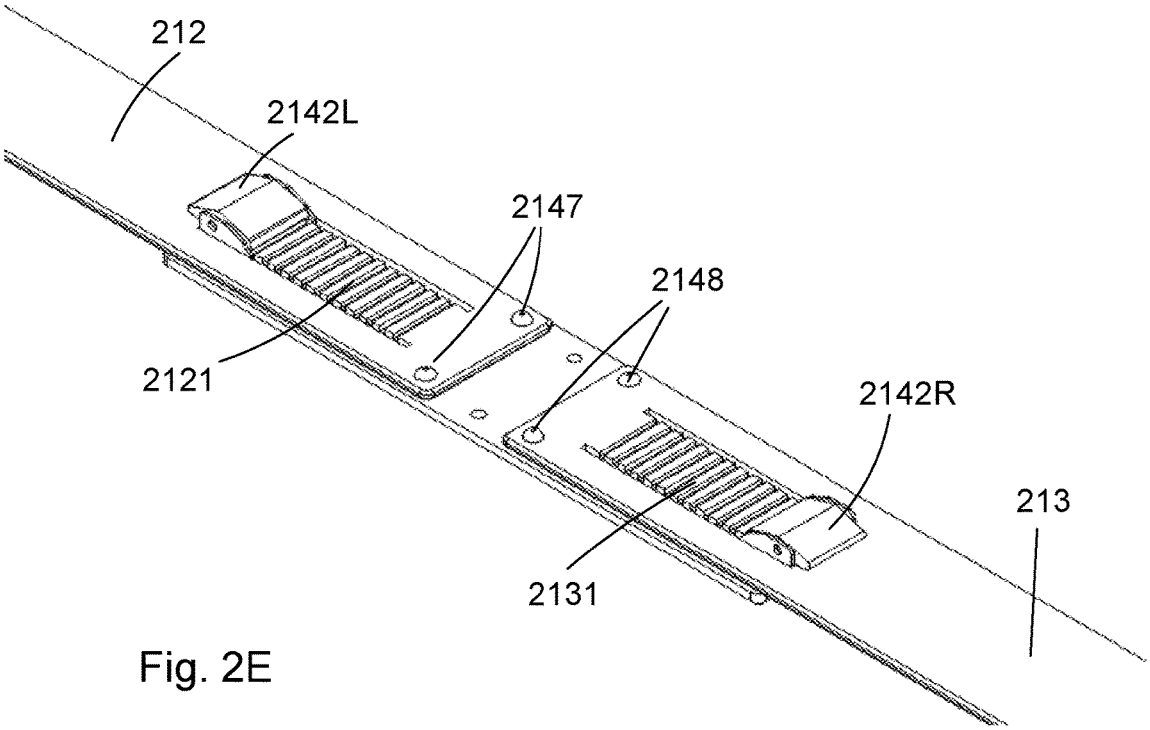
Figure 2F:
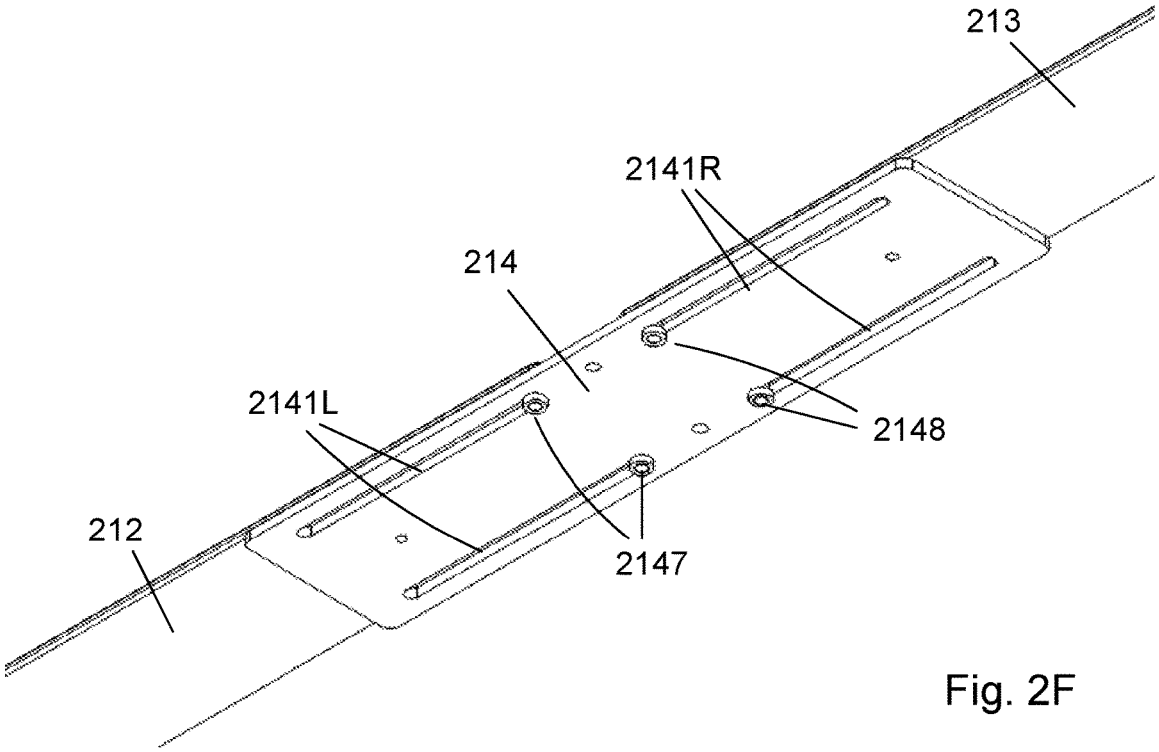

FIG. 2E is a perspectival drawing of the assembly seen at a certain angle from above, while FIG. 2F is a perspectival drawing of the assembly seen at a certain angle from below, the reference numbers used as above.

Figure 3A:
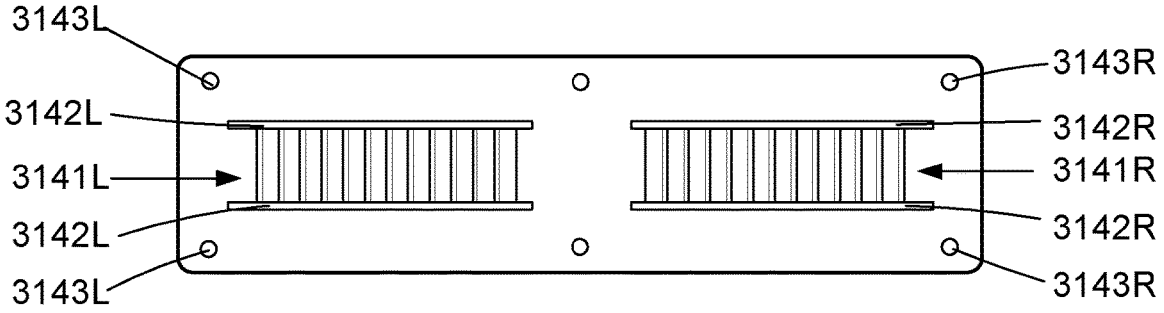
FIGS. 3A-3C illustrate in a second embodiment the attachment between different parts of the duty belt core of the disclosure.
Figure 3B:
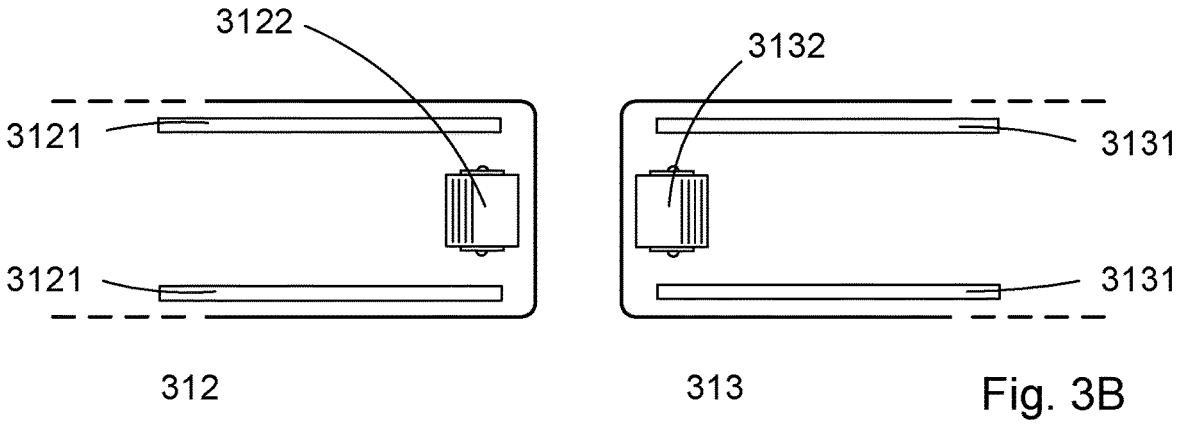
Figure 3C:
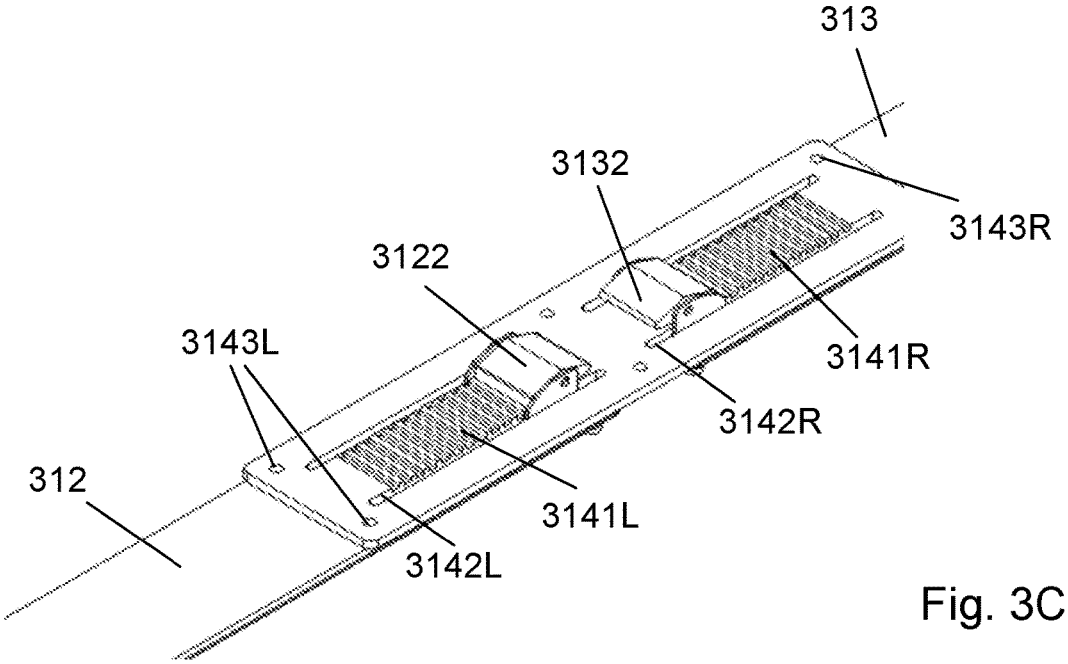

FIGS. 3A-C provide illustrations of an embodiment slightly different from the one shown in reference to FIG. 2 above. While the general functionality is the same, some of the functional elements have switched place. Thus, as shown in FIG. 3A, the back piece 314 does not support brackets, but is instead provided with two areas of ratchet type engravings, illustrated as 3141L and 3141R. Neither does the back piece 314 exhibit any longitudinal slots, but is instead provided with through holes 3143L, 3143R.

As shown in FIG. 3B, ratchet engage-release members 3122 and 3132, generally corresponding to 2142L and 2142R in FIG. 2A, are attached near the back ends of left hand piece 312 and right hand piece 313 respectively. After assembling of the back piece 314 to both side hand pieces 312, 313, each one of the ratchet engage-release members interacts with each one of the engraved ratchet type engravings in generally the same manner as described above.

There are a few aspects that clearly separate this embodiment from the previous one, also in relation to functionality. Firstly, the side pieces will in the embodiment of FIGS. 3A-B rest against the users back while the back piece lies externally of the side pieces. Next, the positions of the ratchet engage-release members will depend on the tightening and slackening of the belt.

FIG. 3C provides a perspectival view of the embodiment illustrated in FIGS. 3A and 3B.

As a whole, the embodiment of FIGS. 2A-F may be seen as slightly advantageous over the embodiment of FIGS. 3A-C.

Figure 4A:
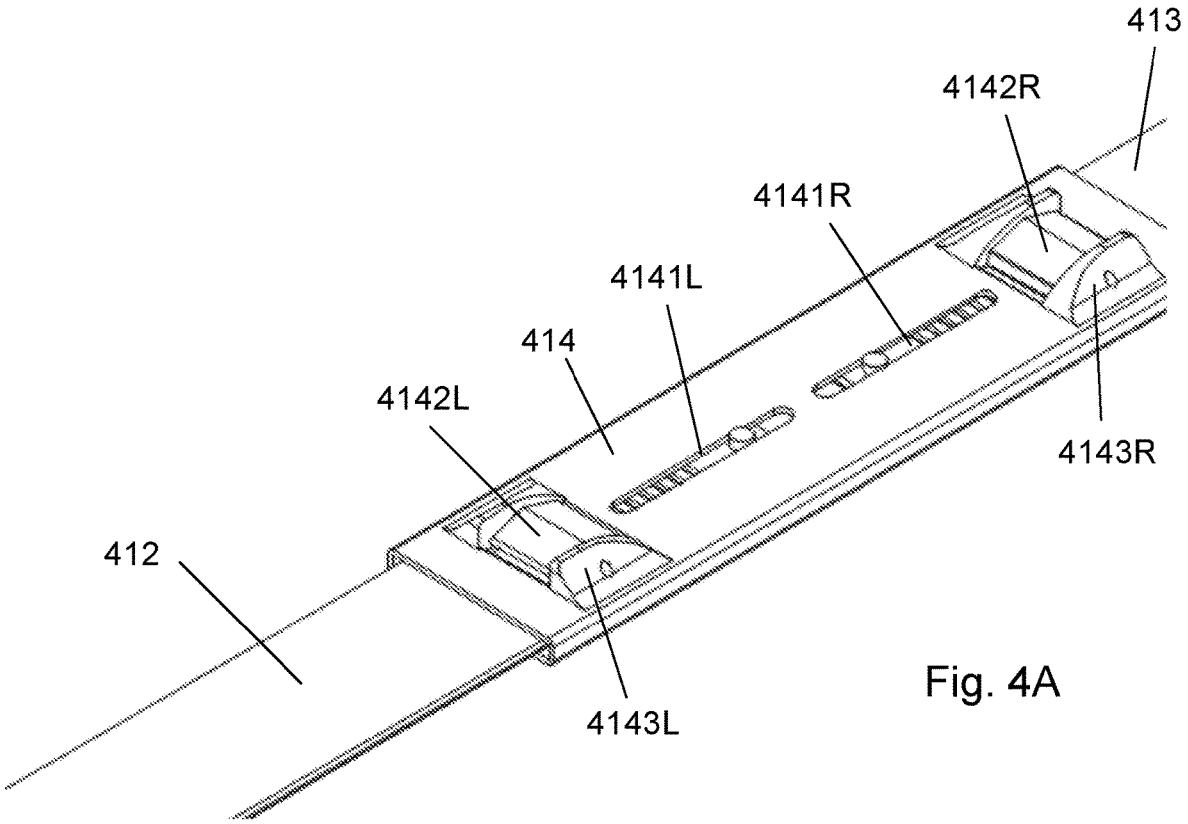
FIGS. 4A-4B illustrate in a third embodiment the attachment between different parts of the duty belt core of the disclosure.

FIG. 4A illustrates still another embodiment. In this embodiment, the back piece 414 is shaped as a flat, elongate housing or tunnel open in both ends, into which the back ends of both side pieces 412, 413 are inserted. This allows a better control of the movement of the ends of the side pieces 412, 413 during tightening and slackening of the belt core and may be seen to constitute an optimal embodiment. The functionality in other respects may be seen as near identical to the one of the FIG. 2 embodiment. That means i.a. that the release members are hinged to brackets attached to the back piece 414, providing a fixed position of the members independent of the tightening and slackening of the belt. It also means that the ratchet type patterns are engraved into the side pieces 412, 413.

The provision of centrally positioned longitudinal slots 4141L and 4141R in the external side of the back piece and a row of circular holes in each of the side pieces to select among for aligning with the slot, allows the additional possibility of cutting excessive lengths of the side pieces at the back ends thereof, i.e. ends that are not visible after assembly of the belt core. That is an advantage over cutting in front, since cutting the belt with a knife or a scissor typically may result in a cutting edge which is not perfectly smooth. This advantage presupposes that ratchet type pattern is engraved in an extended length along each side piece. By "external side" as used above is understood the side facing away from the user when in use.

In the embodiment shown in FIG. 4A, there is just one elongate left hand slot 4141L and one elongate right hand slot 4141R in the back piece 414, rather than the two shown in FIGS. 2 and 3. The slot arrangement is provided for ensuring that the back ends of the side pieces 412, 413 can not be pulled all the way out from the back piece 414 even when one or both of the ratchet engage-release members 4142L, 4142R are activated, that being accidentally by the user or by any third person attempting to disarm the user. For this purpose a screw, rivet or the like (4147 and 4148 respectively) is inserted through each one of the slots and also through a hole through the side piece (412 and 413 respectively) in question, near its back end, and secured in that position by a nut or by any other suitable means.

The brackets 4143L and 4143R may be designed in many different ways and sizes. Aside from their obvious function of holding the engage-release members, they also partly cover the engage-release members, preventing them from being accidentally released. A person skilled in the art will understand that this secondary function is improved if the size of the brackets is increased.

Figure 4B:
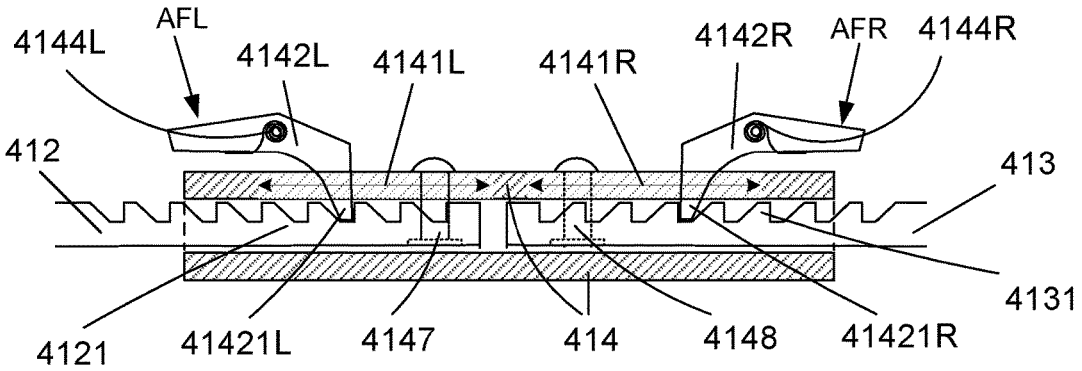

FIG. 4B is a side schematic sectional view of the embodiment in FIG. 4A. The horizontal double-headed arrows at 4141L and 4141 indicate the freedom of movement for the screws 4147 and 4148, such as Chicago screws, thus also the freedom of movement for the left hand piece 412 and the right hand piece 413 in relation to the back piece 414. FIG. 4B also shows spiral springs 4144L and 4144R, designed to bias the pegs 41421L and 41421R of engage-release member 4142L and 4142R respectively to a ratchet engaged position with ratchet pattern 4121 and 4131 respectively, until an activation force AFL and AFR is applied to the engage-release member 4142L and 4142R respectively, thereby bringing the pegs 41421L and 41421R out of engagement with their respective ratchet patterns. Though not shown in FIG. 4B, locking members may be provided adjacent to each of the engage-release members 4142L and 4142R, said locking members being displaceable from an unlocked position not interacting with the engage-release member in question to a locked position in which the engage-release member cannot be released without first unlocking the locking member. The significance of such locking members would be to lock the ratchet type connections temporarily against any movement, thereby preventing contraction (length reduction) as well as extension of the duty belt core.

It should here be emphasized that the relative dimensions of the drawing may be distorted; FIG. 4B is just for the purpose of illustrating the principle. It should furthermore be mentioned that while the engraved ratchet type pattern shown, has a vertical side over which the peg of the ratchet engage-release member 4142 (L and R respectively) cannot slip and an inclined side over which the peg may slip, it is fully possible to use a pattern in which both sides are vertical, provided the relevant side of the peg is made with a suitable inclination instead.

Figure 4C:
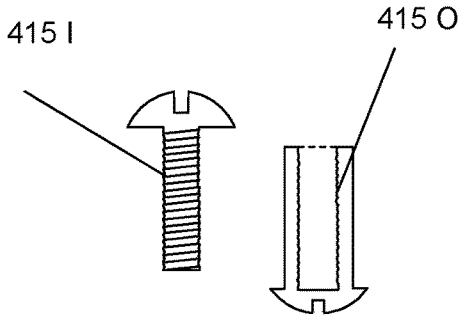
FIG. 4C illustrates a suitable means for mutual attachment of individual parts of the belt core according to the third embodiment and other embodiments of the duty belt core.
Figure 4C:
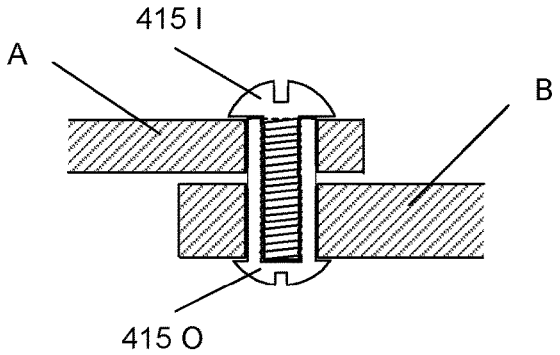

FIG. 4C illustrated schematically a Chicago screw consisting of an inner screw 415-1 with external threads and an outer screw 415-0 with internal threads, the latter typically having a length long enough to fully receive the inner screw 415-1 without squeezing two pieces of material A, B joined thereby. These two pieces of materials A, B could in the present application be the upper layer of the back piece 414 (A) and the left hand piece 412 (B) or the right hand piece 413 (B) respectively. Chicago screws may be used also in connection with other disclosed embodiments, not just the one shown in FIGS. 4A-B.

Figure 4D:
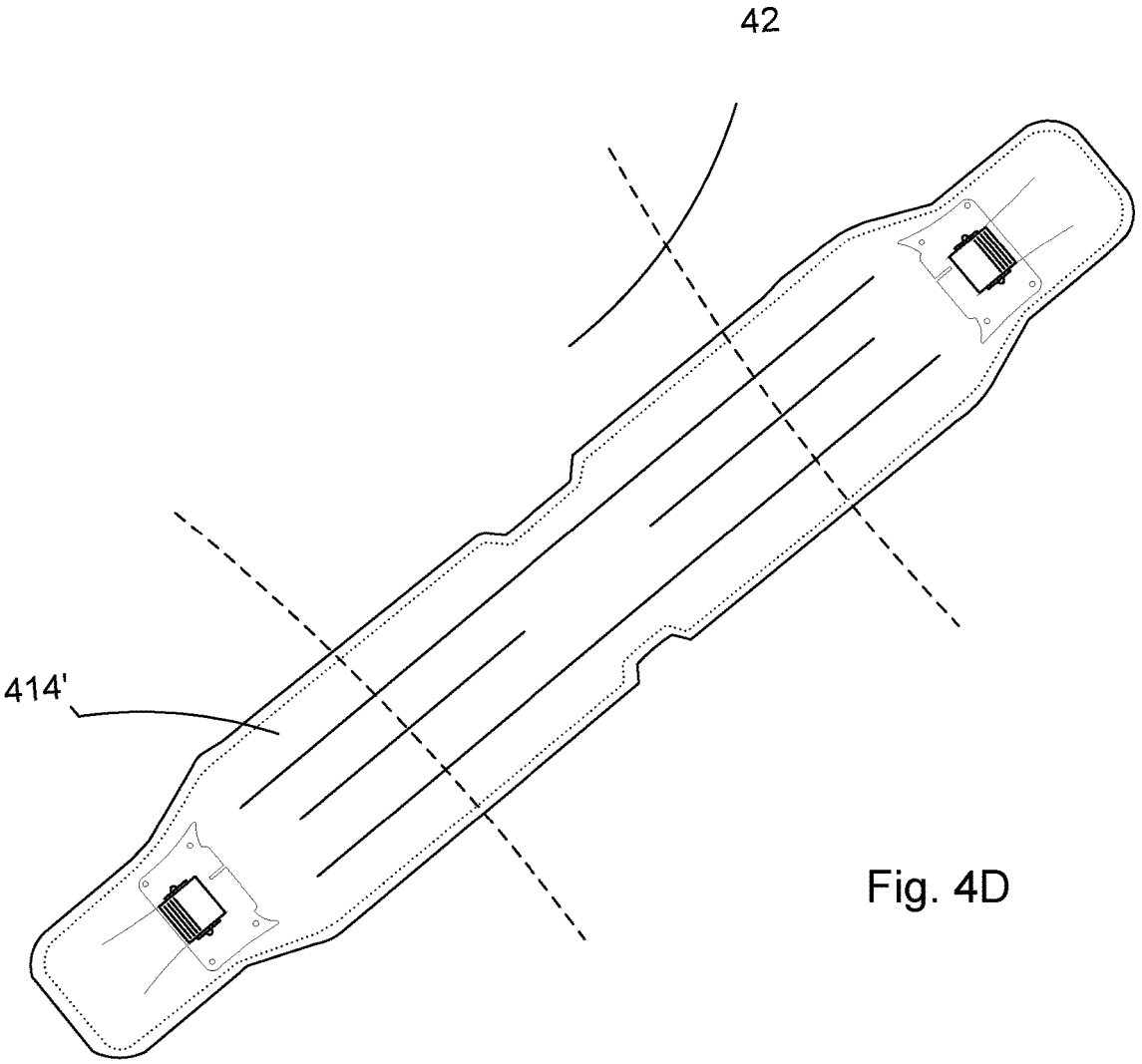
FIG. 4D illustrates a variant of the third embodiment shown in FIGS. 4A-4B.

FIG. 4D is an illustration of a back-piece 414' having the same general functionality as the one shown in FIG. 4A. The difference between the two is that the embodiment of FIG. 4A is a minimalistic type of back-piece merely long and wide enough to receive the respective side pieces while the one shown in FIG. 4D is both wider and longer. The size of a user's torso 42 is indicated with broken lines to give an impression of the scale. Increased width will distribute weight and tension over a larger area of the user's body which may be more comfortable when heavy equipment is carried by the belt and also provide support for the users back. FIG. 4D also emphasizes the fact that the back piece in certain embodiments may be long enough to connect to the side pieces more or less at the user's front, the side pieces naturally being correspondingly shorter when used with such an extended back piece.

While all ratchet type patterns illustrated has been visualized as engraved patterns, i.e. in the form of recesses in an otherwise plane surface, a person skilled in the art understands that similar patterns useful with the disclosed embodiments also can be provided as protrusions up from an otherwise plane surface.

Figure 5A:
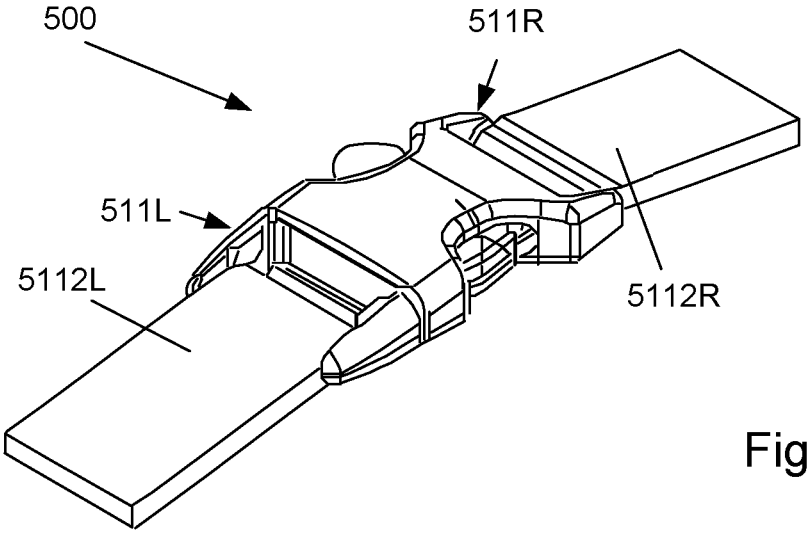
FIGS. 5A-5B illustrate a particulate belt buckle constituting a preferred embodiment but useful also in connections with duty belts outside the scope of the disclosure.
Figure 5B:
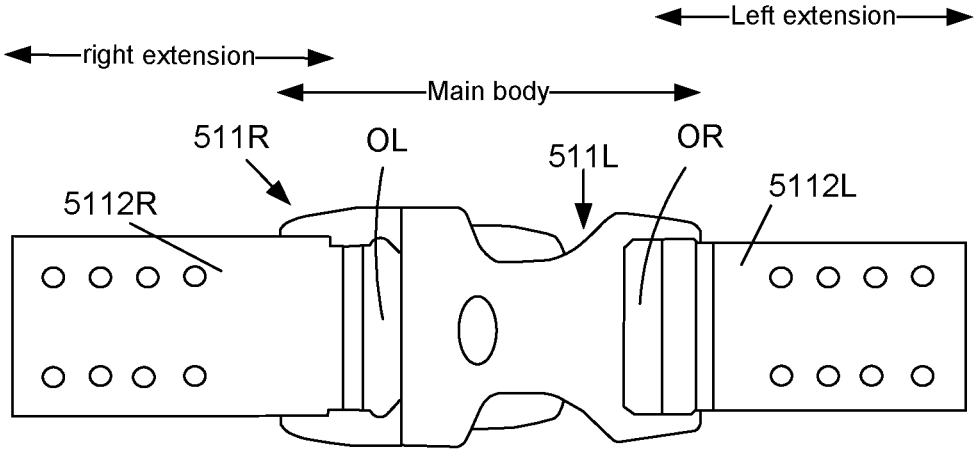
Figure 7A:
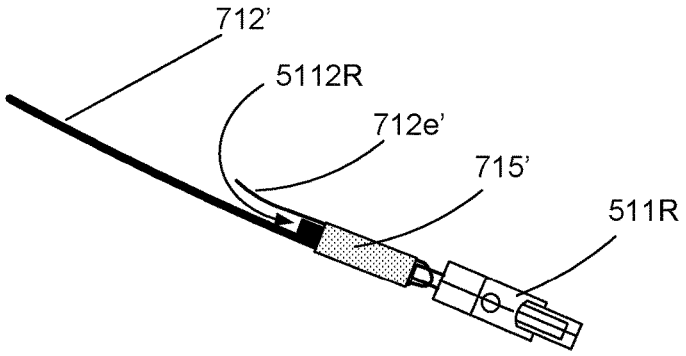
FIGS. 7A-7B illustrate a duty belt according to the prior art provided with a belt buckle according to a particular embodiment of the disclosure.
Figure 7B:
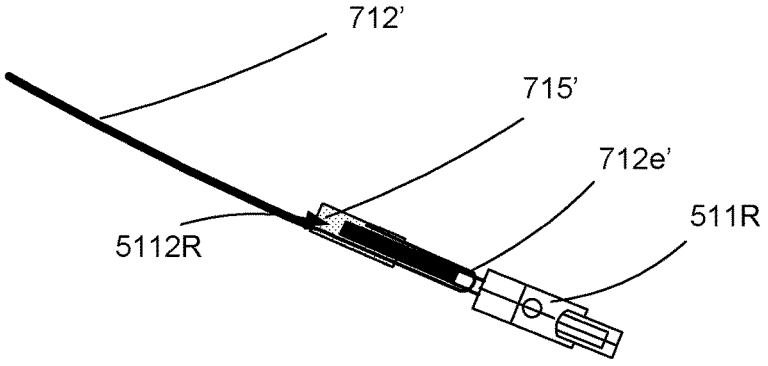

FIGS. 5A-B illustrate a particular belt buckle 511 consisting of a left hand half 511L and a right hand half 511R useful with the duty belt core disclosed herein but also useful with prior art duty belts having length adjustment at the front side of the belt as described in relation to FIGS. 7A-B.

The belt buckle halves 511L and 511R are provided with integrated extensions or wings 5112L and 5112R of a material which may have a rigidity/elasticity similar to the side pieces 212, 213 (or 312, 313; 412,413). This means that the area of attachment between the side pieces 212, 213 (or 312, 313; 412,413) is extended and therefore the tensions thereon caused by loads applied to the belt, are distributed over the extended area with a resulting reduced risk for fatigue damage at the point where the belt is attached to the buckle. The extensions are typically in the range from 30 to 100 mm. The material for the extensions 5112L and 5112R may also be the same as for the belt buckle, and will in case typically be more rigid/less elastic than the side pieces.

As indicated in FIG. 5B the extensions may be provided with rows of holes for the attachment, but may also for other embodiments be provided with hook and loop type fasteners, e.g. for the use with conventional type duty belts as further described with reference to FIGS. 6 and 7. It is furthermore indicated in FIG. 5B that there are through openings OL and OR between the extensions and the main body. This is of significance when using the buckle with conventional, prior art type duty belts. As also shown in FIG. 5B the buckle may be of type tri-lock, but it may also be a two-lock type buckle. FIGS. 6A-D provide a schematic, simplified illustrations of a duty belt 600' according to prior art, comprising a main belt part 612' having a rigid core and at least one end 612*e'* having the form of a flexible extension of the main belt part 612', intended for attachment to a belt buckle half 611R' in a manner providing length adjustment of the belt. The belt extension 612*e'* is typically made of braided synthetic fibres or a woven material with a high tensional strength, but of a low rigidity.

Figure 6A:
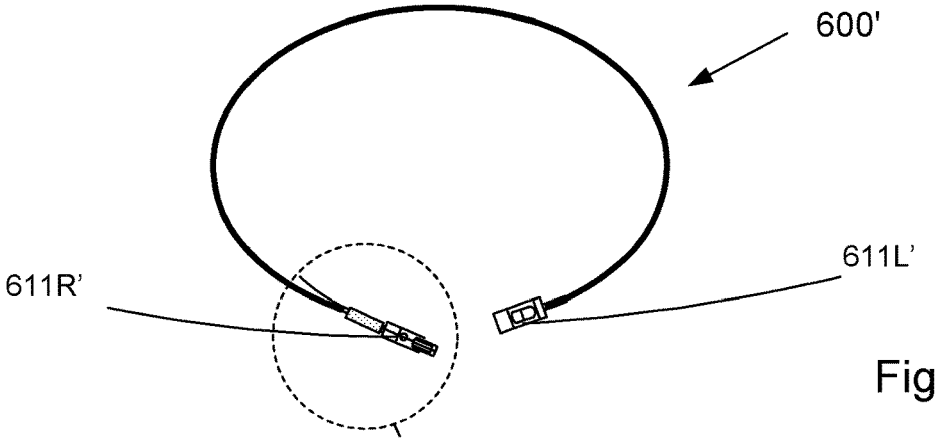
FIGS. 6A-6D illustrates schematically a duty belt according to the prior art.
Figure 6B:
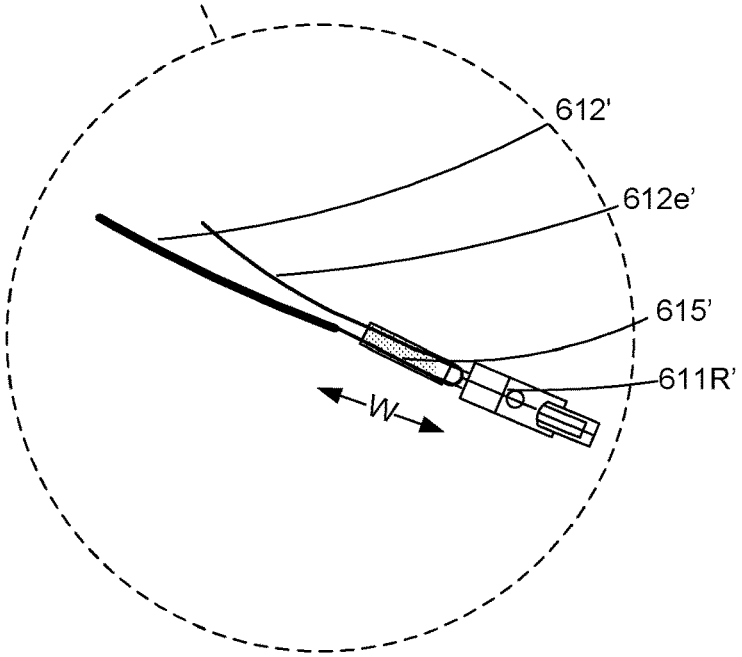
Figure 6C:
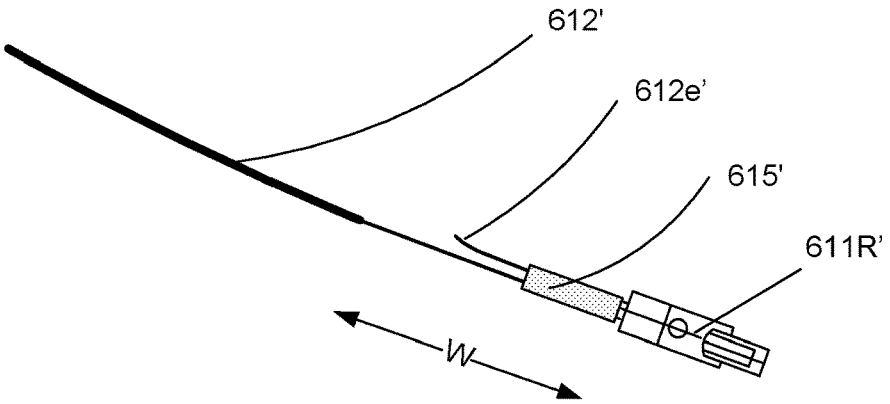

The attachment of the belt extension 612*e'* to the belt buckle half 611' is shown enlarged in FIG. 6B. The longer the free end of the extension, the shorter the belt and vice versa. The belt extension may be provided on one side with hook-and-loop type fasteners to attach the free end of the extension 612*e'* to the part of the extension 612*e'* positioned between the main belt part 612' and the belt buckle half 611R'. In addition a displaceable band loop or belt loop 615' enveloping both mentioned parts of the belt extension 612*e'* with a snug fit, ensures that the belt extension 612*e'* can not slide out of the belt buckle half 611R'. However, the region indicated in FIG. 6B with a double arrow marked "W", is an area of highly reduced belt rigidity, which is undesirable, in particular when the belt is used for carrying equipment of some weight. As illustrated in FIG. 6C, this "weak" or non-rigid region naturally is extended when the belt length is extended.

The band loop or belt loop 615' may be made in different materials, comprising natural and/or synthetic fibrous or non-fibrous materials, and may be provided with buttons or may constitute a continuous loop.

Figure 6D:
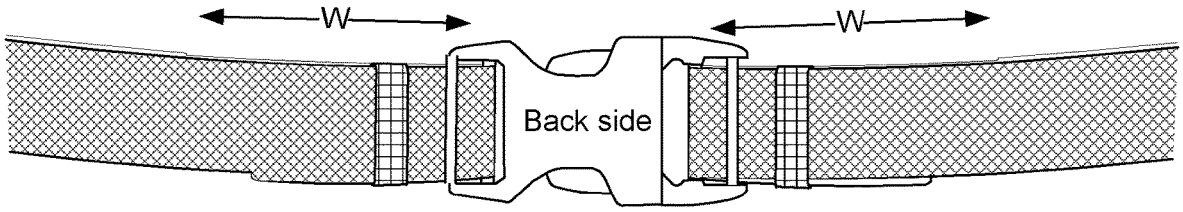

FIG. 6D shows principally the same as FIG. 6C but in a perspectival view.

FIGS. 7A-B illustrate the use of a conventional, prior art duty belt in combination with the presently disclosed belt buckle 511 having extensions 5112L and 5112R (only the right hand half illustrated in FIGS. 7A-B). Due to a significant overlap between the extension 5112R of the belt buckle with the main belt part 712', there is no loss of rigidity in the embodiment of FIG. 7A. Even in the embodiment of FIG. 7B, where the belt has been extended, there is a slight overlap between the extension 5112R and the main belt part 712', and the loss of rigidity is minimal, when using a tailor made band loop 715' which holds the parts tightly together.

With regard to materials for the duty belt core, thermoplastics are generally suitable, hereunder in particular polyethylene (PE), high density polyethylene (HDPE), polyethylene terephthalate (PET) and polypropylene (PP). Polyoxymethylene (POM) is also a viable choice, somewhat stiffer than the other. Different qualities of polyamides may also be used for the duty belt core.

For the belt buckle polyamides are generally suitable materials, hereunder in particular polyamide PA6 and PA6.6 which are widely used in injection moulding techniques which is the most relevant production method for the buckles. POM and PP are also viable materials for the buckle.

It is desirable that the extensions (wings) of the belt buckle is more resilient than the main body of the buckle, and injection moulding readily allows a combination of different resins for the different parts, so that a kind of polyamide may be used for the buckle's main body while e.g. PE may be used for the wings.

For all the different synthetic materials mentioned a suitable UV inhibitor should be included in order to increase the lifetime of the belt and buckle respectively.

While injection moulding is the preferred production method for the buckle, the side pieces may be produced by casting processes, by extrusion or by computer controlled milling from a larger (plate shaped) body. Casting provides a product that is more or less finished without post-treatment while the other methods require some finishing for the product to obtain a desired aesthetical appearance. Milling on the other hand provides the benefit of a very high versatility which may be invaluable if/when complex shapes are desired.

The duty belt core according to the disclosure typically has a thickness between 2 and 3.5 mm and a width (height) of from 35 to 70 mm. For some embodiments the width may vary along the circumference of the belt and may e.g. be wider at the hips and/or in front compared to the parts interacting with the back piece. The dimension is a balance between strength/rigidity on one hand and weight/comfort on the other hand.

The extension (length) of the back piece can be varied from a minimum representing the desired length adjustment, such as e.g. 150 mm, up to any desired length. If it for some embodiments is desired to have the engage-release members arranged at the user's side rather than at the user's back, then the back piece is dimensioned correspondingly. Dependent on the design and size of the engage-release member and/or any bracket used for its attachment, it may preferred not to have the engage-release members in a region in which it will be come between the users back and a the back of a chair if he sits down.

To combine the disclosed duty belt core with a soft lining or the like in the assembly of a complete duty belt, hook-and-loop type fasteners (such as Velcro® fasteners) are typically mounted to the side pieces as well as to the back piece of the duty belt core, as continues strips or intermittent patches, full width of the duty belt core or more often to a central area along the length of the duty belt core, typically in a recessed groove to protect it from undesired mechanical influence and for allowing parts of the side pieces applied with such fastening means the ability to slide into the back piece of the duty belt core if required. The parts of the side pieces intended to slide into the back piece when tightening/shortening the duty belt core should naturally not be provided with cushioning material. Therefore, a particularly slim user who needs to cut off a significant length of the side pieces should take care not to cut so much at the back of the side pieces that this becomes a problem. Some of or all of the cut-offs should then be made at the front ends of the side pieces to avoid this problem. Similar lengths should be cut off each side piece in order to maintain the symmetry of the belt.

Main advantages of the duty belt core according to the disclosure are:

- Full rigidity 360 degrees around the users waist without sacrificing adjustment possibilities;
- Quicker length adjustments, allows adjust in a second e.g. when sitting down or getting up;
- Minimal displacement of tools and weapons related to length adjustments of the belt;
- It is a health issue being able to quickly release the belt to a comfortable level when getting out of a physically active position, such as when sitting down in a car or for writing a report etc.

In some situations it may be critical that the tools or weapons are found at exactly the same position on the body, especially for police offers in duty and military personnel in combat situations. The symmetric adjustments according to the disclosed embodiments, at the back of the user, provides a solution to this challenge, since adjustments of prior art duty belts typically affects the position of the tools and tool holders placed around the belt.

For construction works etc. who typically do not operate in such stressful situation as mentioned above, the full rigidity of the duty belt core is perhaps its most important property, allowing it to carry heavy weights, like buckets of paint, relieving the arms for such loads.

For particular purposes, the duty belt core may furthermore be provided with vertical extensions, upwards and downwards from the waistline, to allow distribution of weight over a larger body area, and/or to provide a larger area for tools and tool holders to be attached thereto. This latter feature may be particularly useful for persons with a slim waistline.

In the claims enclosed, many of the reference numerals could be made in respect to plural drawings. In order not to overload the claims with reference numerals, such references are given just to drawings 2A-F, where appropriate.

The invention claimed is:

1. A duty belt core (100) for forming a rigid core of a duty belt, comprising:

- a left hand side piece (212) firmly attached to a left hand half (211L) of a front belt buckle (211),
- a right hand side piece (213) firmly attached to the right hand half (211R) of the front belt buckle, wherein
- each of the left hand (212) and right hand (213) side pieces is connected to a common back piece (214) by a side-symmetrical length adjustment arrangement controlled by a pair of engage-release members (2142L, 2142R), and
- at least one safety stop is configured (2141L, 2123, 2147; 2141R, 2133, 2148) to prevent accidental disengagement of the left hand side piece (212) and the right hand side piece (213) from the common back piece (214).

2. The duty belt core (100) of claim 1, wherein the side-symmetrical length adjustment arrangement comprises patterns of repetitive protrusions and recesses in one of the back piece (214) and the group of the two side pieces (212, 213) and correspondingly arranged engage-release members (2142L, 2142R) on one of the left hand side piece (212) and the right hand side piece (213) and the back piece (214), and the other of the back piece (214) and the group of the two side pieces (212, 213) not being provided with said patterns.

3. The duty belt core of claim 1, wherein the side-symmetrical length adjustment arrangement comprises a ratchet length adjustment connection (2121, 2131).

4. The duty belt core of claim 3, wherein each of the side symmetrical length adjustment arrangement is fixated with a spring biased engage-release member (2142L, 2142R) preventing extension of the duty belt core (100) until at least one of the engage-release members (2142L, 2142R) is manually released.

5. The duty belt core of claim 1, wherein the safety stop preventing accidental disengagement comprises at least two longitudinal slots (2141L, 2141R) in the back piece and corresponding holes (2123, 2133) in each of the side pieces, penetrated by screws or rivets (2147, 2148), holding the back piece (214) and the side pieces (212, 213) in mutually slideable relation limited to the length of the slots (2141L, 2141R).

6. The duty belt core of claim 1, wherein the safety stop preventing accidental disengagement comprises at least one longitudinal slot (3121, 3131) in each of the side pieces and corresponding holes (3141L, 3141R) in the back piece, penetrated by screws or rivets, holding the back piece (314) and the side pieces (312, 313) in mutually slideable relation limited to the length of the slots (3121, 3131).

7. The duty belt core of claim 2, wherein the patterns of repetitive protrusions and recesses (2121, 2131) are engraved in each of the side pieces (212, 213) near a back end thereof, arranged to be engaged by each one of two pattern-adapted pegs pivotally mounted to the back piece (2121, 2131) as part of the engage-release member (2142L, 2142R).

8. The duty belt core of claim 2, wherein the two patterns of repetitive protrusions and recesses (3141L, 3141R) are engraved in the back piece (314), symmetrically about a length axis thereof, each of the patterns of repetitive protrusions and recesses (3141L, 3141R) being arranged to be engaged by a pattern-adapted peg pivotally mounted to each one of the side pieces (312, 313), proximate a back end thereof, as part of the engage-release member (3122, 3132).

9. The duty belt core of claim 7, wherein the back piece (214) is a single layer piece arranged to rest against a wearer's back while parts of the side pieces (212, 213) overlapping the back piece (214) are arranged to slide against an external side of the back piece (214).

10. The duty belt core of claim 8, wherein the back piece (314) is a single layer piece arranged to be positioned externally in relation to parts of the side pieces (312, 313) overlapping the back piece (314).

11. The duty belt core of claim 1, wherein the back piece (414) has a shape of a flat tunnel open on opposite ends, holding engage-release members (4142L, 4142R) externally, each of the engage-release members (4142L, 4142R) having a peg (41421L, 41421R) arranged to engage with ratchet patterns (4121, 4131) in the side pieces (412, 413), the back piece (414) being slideably attached to each of the side pieces by means of a projection (4147, 4148) penetrating the side pieces and elongate slots (4141L, 4141R) in an external side of the back piece (414).

12. The duty belt core of claim 5, wherein the screws or rivets (217, 2148; 4147, 4148) are Chicago screws.

13. The duty belt core of claim 1, wherein the side symmetrical length adjustment arrangement is a ratchet length adjustment arrangement in which at least one of (i) each pattern of repetitive protrusions and recesses and (ii) a peg adapted to said pattern is provided with an inclined surface, thereby allowing the peg to slide past the protrusions in a direction of tightening the duty belt core.

14. A belt buckle (500) for a duty belt, comprising a main body and external, rigid extensions or wings (5112L, 5112R) to both sides, providing extended, rigid contact area between any belt connected thereto and the buckle (500).

15. The belt buckle (500) of claim 14, wherein each extension is integral with each respective half of the main body of the belt buckle, such as casted in a common casting process.

16. The belt buckle of claim 14, wherein the extensions or wings (5112L, 5112) are provided with holes for attachment to a duty belt or duty belt core.

17. The belt buckle of claim 14, wherein the extensions or wings (5112L, 5112R) are provided with pads having hooks or loops for connection with duty belt having corresponding respective loops or hooks.

18. The duty belt core of claim 2, wherein the safety stop preventing accidental disengagement comprises at least two longitudinal slots (2141L, 2141R) in the back piece and corresponding holes (2123, 2133) in each of the side pieces, penetrated by screws or rivets (2147, 2148), holding the back piece (214) and the side pieces (212, 213) in mutually slideable relation limited to the length of the slots (2141L, 2141R).

19. The duty belt core of claim 2, wherein the safety stop preventing accidental disengagement comprises at least one longitudinal slot (3121, 3131) in each of the side pieces and corresponding holes (3141L, 3141R) in the back piece, penetrated by screws or rivets, holding the back piece (314) and the side pieces (312, 313) in mutually slideable relation limited to the length of the slots (3121, 3131).

20. The duty belt core of claim 2, wherein the side-symmetrical length adjustment arrangement comprises a ratchet length adjustment connection (2121, 2131).

* * * * *